US006047672A

United States Patent [19]

Hanai et al.

[11] Patent Number: 6,047,672

[45] Date of Patent: Apr. 11, 2000

[54] ENGINE VALVE-DRIVING ELECTROMAGNETIC VALVE

[75] Inventors: Kazumichi Hanai; Junya Kimoto; Eisuke Kato, all of Obu, Japan

[73] Assignee: Aisan Kogyo Kabushiki Kaisha, Japan

[21] Appl. No.: 09/261,833

[22] Filed: Mar. 3, 1999

[30] Foreign Application Priority Data

Mar. 4, 1998 [JP] Japan ..... 10-067618

[51] Int. Cl.[7] ..... F01L 9/04; H01F 7/16

[52] U.S. Cl. ..... 123/90.11; 251/129.01

[58] Field of Search ..... 123/90.11, 90.15; 251/129.01, 129.05, 129.09, 129.1, 129.15, 129.18

[56] References Cited

U.S. PATENT DOCUMENTS

| | | | |
|---|---|---|---|
| 4,706,619 | 11/1987 | Buchl | 123/90.11 |
| 4,794,891 | 1/1989 | Knobloch | 123/90.11 |
| 5,636,601 | 6/1997 | Moriya et al. | 123/90.11 |
| 5,671,705 | 9/1997 | Matsumoto et al. | 123/90.11 |
| 5,748,433 | 5/1998 | Schrey et al. | 361/210 |
| 5,775,276 | 7/1998 | Yanai et al. | 123/90.11 |
| 5,782,211 | 7/1998 | Kamimaru | 123/90.11 |
| 5,791,305 | 8/1998 | Kather et al. | 123/90.11 |
| 5,964,192 | 10/1999 | Ishii | 123/90.11 |

OTHER PUBLICATIONS

Patent Abstracts of Japan 07083012 A dated Mar. 28, 1995.
Patent Abstracts of Japan 08205508 A dated Aug. 9, 1996.
English Language Abstract of JP 5–87267 dated Apr. 6, 1993.

*Primary Examiner*—Weilun Lo
*Attorney, Agent, or Firm*—Baker Botts L.L.P.

[57] ABSTRACT

A method of driving an engine valve-driving electromagnetic valve, wherein a permanent magnet is provided in a movable element of the electromagnetic valve, and springs are omitted, and wherein repulsion and attraction electric currents are varied according to the engine speed, thereby reducing the electric power consumption. The permanent magnet is magnetized in the axial direction. When the repulsion current is passed through one exciting coil, the attraction current is passed through the other exciting coil, thereby moving an engine valve to an open position. When the attraction current is passed through the one exciting coil, the repulsion current is passed through the other exciting coil, thereby moving the engine valve to a closed position. In the low-engine speed region, the current value is smaller and the energization time is longer than in the high-engine speed region.

4 Claims, 5 Drawing Sheets

ENGINE VALVE-DRIVING ELECTROMAGNETIC VALVE

BACKGROUND OF THE INVENTION

The present invention relates to a method of driving an engine valve-driving electromagnetic valve that drives an intake or exhaust valve of an engine to open or close by electromagnetic force produced by a combination of an electromagnet and a permanent magnet.

It is known that an engine valve is driven by an electromagnetic valve in place of a cam drive mechanism. FIG. 6 is a sectional side view showing the whole structure of a conventional engine valve-driving electromagnetic valve [for example, see Japanese Patent Application Unexamined Publication (KOKAI) No. 7-83012]. A port 45 is formed in an intake/exhaust passage (an intake passage or an exhaust passage) 12 of a cylinder head 10 of an engine. A valve head 14 of an intake/exhaust valve (an intake valve or an exhaust valve) is provided so as to be capable of reciprocating toward the port 45, thereby forming an engine valve 11. An electromagnetic valve 1 is provided adjacently to the cylinder head 10. The electromagnetic valve 1 has a casing 2 made of a non-magnetic material. A first core 3 and a second core 4 are provided in the upper and lower end portions of the casing 2. The first and second cores 3 and 4 are annular cores having a U-shaped cross-sectional configuration and made of a magnetic material. A movable element 7 is placed between the first core 3 and the second core 4. The movable element 7 is formed from a magnetically attracting iron plate. The movable element 7 is secured to the distal end of a valve stem 16 of the engine valve 11. A first exciting coil 5 is incorporated in a groove of the first core 3. Similarly, a second exciting coil 6 is incorporated in a groove of the second core 4. When supplied with a predetermined electric current from a driver circuit, the first exciting coil 5 and the second exciting coil 6 each produce a magnetic field whose intensity corresponds to the value of the supplied electric current, causing a magnetic flux corresponding to the magnetic field intensity to pass through each of the first and second cores 3 and 4.

The magnetic flux produced by each of the first and second exciting coils 5 and 6 returns through the first core 3 or the second core 4, the movable element 7 and an air gap lying therebetween. The air gap forms a part of the magnetic circuit. The magnetic reluctance of each of the first core 3, the second core 4 and the movable element 7, which are each made of a magnetic material, is at a level that may be ignored in comparison to the magnetic reluctance of the air gap. The magnetic reluctance of the air gap is a function of the gap length. The smaller the gap, the smaller the magnetic reluctance, and the more stable is the magnetic circuit. When an electric current is supplied alternately to the first exciting coil 5 and the second exciting coil 6 from the driver circuit, an electromagnetic attraction force corresponding to the supplied electric current is produced. Consequently, the movable element 7 is attracted to the first exciting coil 5 or the second exciting coil 6 alternately. Thus, driving force required to drive the engine valve 11 can be obtained.

In the electromagnetic valve 1, if the movable element 7 is driven simply by switching the supply of the electric current, which is supplied to the first exciting coil 5 and the second exciting coil 6 alternately, without giving any special consideration to the mechanism, there will be considerable variations in the time required for the movable element 7 to complete its movement from the instant when the supply of the electric current is switched. Therefore, practical control cannot be realized. For this reason, a vibration system is formed by using springs so that a movable system including the valve body (comprising the valve head 14 and the valve stem 16) and the movable element 7 is held in a predetermined neutral position and the movable system is allowed to vibrate by predetermined free vibration. With this arrangement, when the supply of the electric current is cut off in a state where the movable element 7 is placed in contact with the first exciting coil 5 or the second exciting coil 6, the movable element 7 immediately begins simple harmonic motion away from the exciting coil. Accordingly, the open-close cycle of the valve body can be controlled with high accuracy by controlling the length of time that the movable element 7 is held in contact with the first exciting coil 5 or the second exciting coil 6.

A spring 8 is fitted between-the upper side of the movable element 7 and the upper end of the casing 2. A spring 9 is fitted between the lower side of the movable element 7 and the lower end of the casing 2. The springs 8 and 9 are non-linear springs each having a reduced diameter at a central portion thereof. The spring constant of the springs 8 and 9 is small in a region where the displacement is small, but large in a region where the displacement is large. Accordingly, in the vicinity of the intermediate position, the spring force produced from the springs 8 and 9 is small in comparison to linear springs. Therefore, the arrangement using the springs 8 and 9 is useful for driving. In the vicinities of the open and closed positions of the engine valve 11, the springs 8 and 9 produce large spring force. Therefore, the arrangement does not degrade the response of the electromagnetic valve 1. Thus, the electromagnetic attraction force acting on the movable element 7 and the spring force of the springs 8 and 9 are matched to each other at all times, and the generation of excessive electromagnetic attraction force is avoided.

SUMMARY OF THE INVENTION

The conventional electromagnetic valve has the disadvantage that even when the engine speed, i.e. the number of revolutions, changes, the electromagnetic valve operates mechanically with the same response time at all times, and there is no change in the electric power consumption required for driving. Therefore, there is a limit to the reduction in the electric power consumption.

An object of the present invention is to provide a method of driving an engine valve-driving electromagnetic valve, wherein a permanent magnet is provided in a movable element of the electromagnetic valve, and springs are omitted, and wherein repulsion and attraction electric currents are varied according to the engine speed, thereby reducing the electric power consumption.

The present invention is applied to an engine valve-driving electromagnetic valve including a fixed element formed from a cylindrical casing of a ferromagnetic material, two fixed iron cores having cylindrical portions, respectively, two exciting coils, and an annular intermediate plate of a ferromagnetic material. The engine valve-driving electromagnetic valve further includes a movable element formed from a movable iron core, a permanent magnet, and another movable iron core, which are stacked successively. The movable element is secured to the distal end of a valve stem. The movable element is supported axially movably between the cylindrical portions of the fixed iron cores. The fixed element and the movable element are formed in symmetry with respect to the axis. An electric current is passed through the exciting coils to excite a magnetic circuit formed by the fixed element and the movable element, so that the movable element is driven in the axial direction by electromagnetic force, thereby driving an engine valve to open or close. According to a first arrangement of the present invention, the permanent magnet is magnetized in the axial direction, and when a repulsion electric current for producing a repulsive force is passed through one of the exciting coils, an attraction electric current for producing an attractive force is passed through the other of the exciting coils, thereby moving the engine valve to an open position where it is open. When the attraction electric current is passed through the one of the exciting coils, the repulsion electric current is passed through the other of the exciting coils, thereby moving the engine valve to a closed position where it is closed. The repulsion electric current and the attraction electric current are varied according to the engine speed such that, in the low-engine speed region, the electric current value is smaller and the energization time is longer than in the high-engine speed region.

According to a second arrangement of the present invention, when the engine valve is in one of the closed position and the open position, a magnetic circuit is formed by the magnetic flux from the permanent magnet of the movable element, and by excitation of this magnetic circuit, the engine valve is held in the one of the closed position and the open position.

According to a third arrangement of the present invention, a cylindrical projection is formed on an end surface of each of the movable iron cores of the movable element in either of the first and second arrangements. A tapered slant surface is formed on the outer side of the distal end of one of the mutually opposing surfaces of each fixed iron core and the corresponding movable iron core of the movable element, and an inversely-tapered slant surface is formed on the inner side of the distal end of the other of the mutually opposing surfaces, so that a magnetic flux passes through the two slant surfaces.

In the method of driving an engine valve-driving electromagnetic valve according to the present invention, the permanent magnet is magnetized in the axial direction. When the repulsion electric current is passed through one exciting coil, the attraction electric current is passed through the other exciting coil, thereby moving the engine valve to the open position. When the attraction electric current is passed through the one exciting coil, the repulsion electric current is passed through the other exciting coil, thereby moving the engine valve to the closed position. The repulsion electric current and the attraction electric current are varied according to the engine speed such that, in the low-engine speed region, the electric current value is smaller and the energization time is longer than in the high-engine speed region. Because a permanent magnet is provided in the movable element of the electromagnetic valve and springs are omitted, the electric power consumption is reduced. In addition, the repulsion and attraction electric currents are varied according to the engine speed such that, in the low-engine speed region, the electric current value is smaller and the energization time is longer than in the high-engine speed region. Thus, the electric power consumption is reduced.

Still other objects and advantages of the invention will in part be obvious and will in part be apparent from the specification.

The invention accordingly comprises the features of construction, combinations of elements, and arrangement of parts which will be exemplified in the construction hereinafter set forth, and the scope of the invention will be indicated in the claims.

BRIEF DESCRIPTION OF THE DRAWINGS

FIGS. 2A and 2B are diagrams for describing the operation of the embodiment of the present invention, in which FIG. 2A shows the electromagnetic valve when the engine valve is fully closed, and FIG. 2B shows the electromagnetic valve when the engine valve is fully open.

DESCRIPTION OF THE PREFERRED EMBODIMENT

Figure 1:
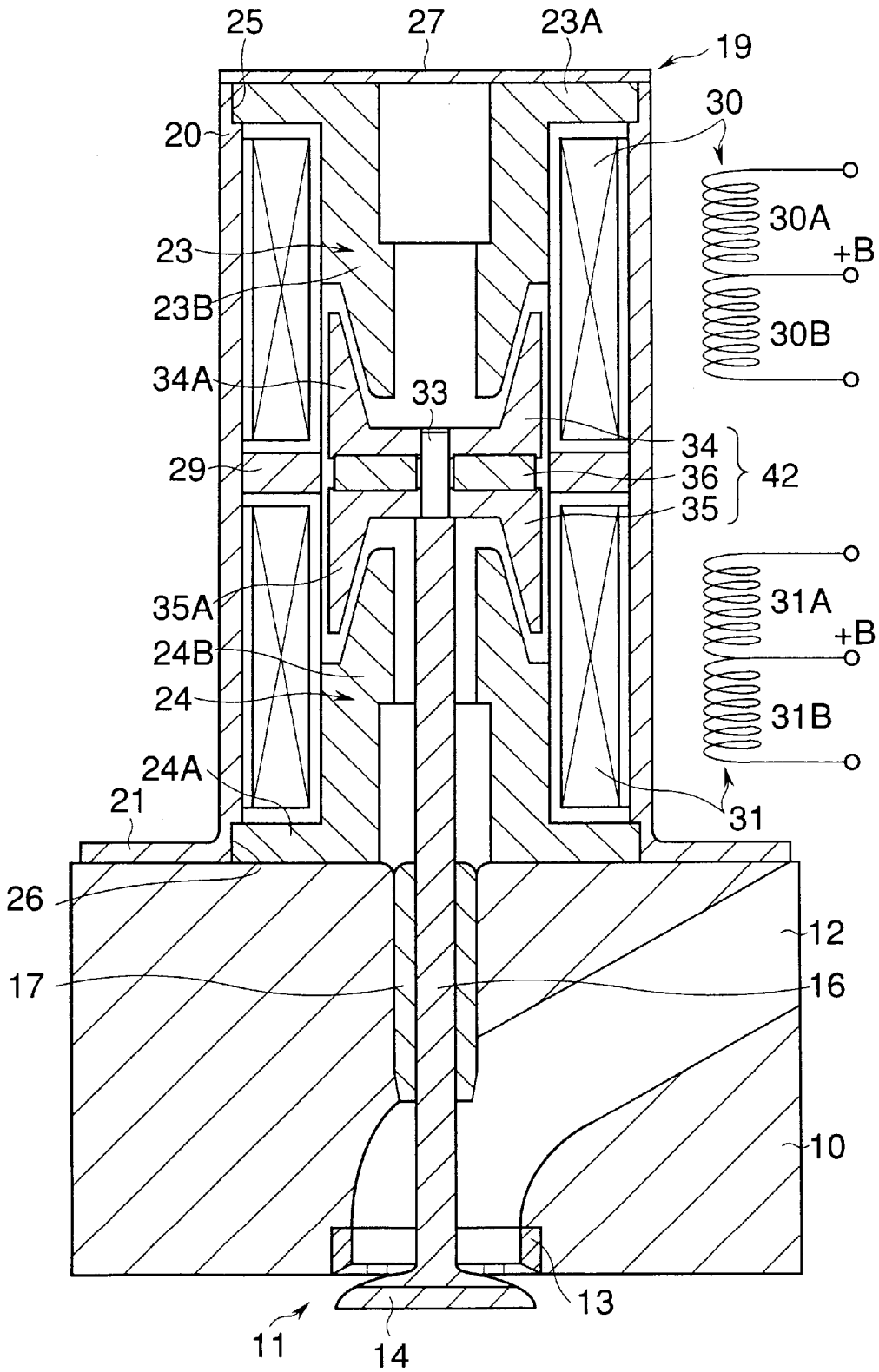
FIG. 1 is a sectional view of an embodiment of an engine valve-driving electromagnetic valve according to the present invention.
Figure 6:
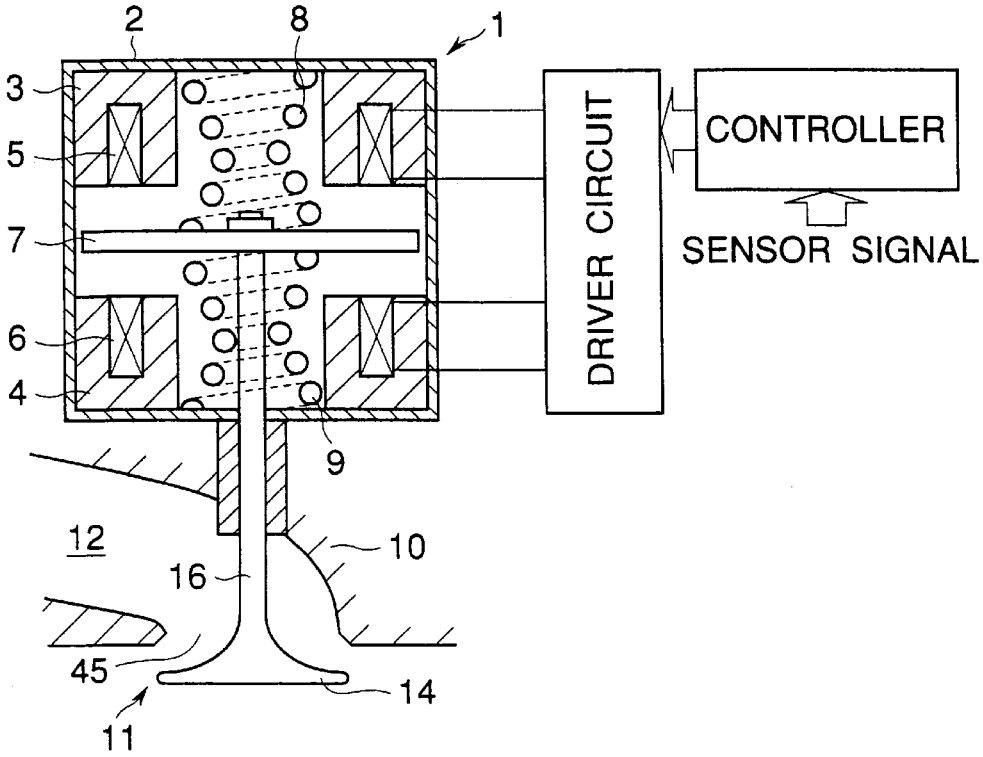
FIG.6 PRIOR ART
FIG. 6 is a sectional view showing a conventional engine valve-driving electromagnetic valve.

FIG. 1 is a sectional view of an embodiment of an engine valve-driving electromagnetic valve according to the present invention. Of members shown in FIG. 1, those which correspond to the members of the prior art shown in FIG. 6 are denoted by the same reference numerals. A seat ring 13 is provided in a port of an intake/exhaust passage (an intake passage or an exhaust passage) 12 in a cylinder head 10 of an engine. A valve head 14 of an intake/exhaust valve (an intake valve or an exhaust valve) is provided so as to be capable of reciprocating toward the seat ring 13, thereby forming an engine valve 11. The intake/exhaust valve is produced from a non-magnetic material such as a heat-resisting steel, e.g. SUH35 (JIS), or ceramics. The intake/exhaust valve has a valve stem 16 supported by a valve guide 17.

An electromagnetic valve 19 is provided adjacently to the cylinder head 10. The electromagnetic valve 19 has a cylindrical casing 20 made of a ferromagnetic material. The casing 20 has a flange 21 at the lower end thereof. The flange 21 is secured to the cylinder head 10. A first fixed iron core 23 in the shape of a stepped cylinder has a flange portion 23A at one end thereof. The flange portion 23A is secured to the inner surface of one axial end (upper end) of the casing 20. A second fixed iron core 24 in the shape of a stepped cylinder has a flange portion 24A at a lower end thereof. The flange portion 24A is secured to the inner surface of the other axial end (lower end) of the casing 20. A first annular groove 25 and a second annular groove 26 are formed in the respective inner peripheral surfaces of the upper and lower ends of the casing 20. The outer peripheral portion of the flange portion 23A of the first fixed iron core 23 is fitted into the first annular groove 25, and a plate 27 is secured to the upper end surface of the casing 20 and also to the upper end surface of the flange portion 23A. Thus, the first fixed iron core 23 is connected to the casing 20. The outer peripheral portion of the flange portion 24A of the second fixed iron core 24 is fitted into the second annular groove 26, and the respective lower end surfaces of the casing 20 and the flange portion 24A are disposed to abut on the surface of the cylinder head 10. Thus, the second fixed iron core 24 is connected to the casing 20. A cylindrical portion 23B of the first fixed iron core 23 and a cylindrical portion 24B of the second fixed iron core 24 project axially inward of the casing 20. The bore diameter of the cylindrical portion 23B is larger at the upper portion than at the lower portion thereof. The bore diameter of the cylindrical portion 24B is larger at the lower portion than at the upper portion thereof.

An annular intermediate plate 29 is secured to the inner surface of the casing 20 at an axial (vertical) center position thereof. The inner diameter of the annular intermediate plate 29 is the same as the outer diameter of the cylindrical portion 23B of the first fixed iron core 23 and also the same as the outer diameter of the cylindrical portion 24B of the second fixed iron core 24. As illustrated in the figure, the projecting end of each of the cylindrical portions 23B and 24B has an annular plane surface. A first exciting coil 30 is fitted between the flange portion 23A of the first fixed iron core 23 and the annular intermediate plate 29. A second exciting coil 31 is fitted between the flange portion 24A of the second fixed iron core 24 and the annular intermediate plate 29. Thus, the casing 20, the first fixed iron core 23, the second fixed iron core 24, the annular intermediate plate 29, the first exciting coil 30 and the second exciting coil 31 form a fixed element of the electromagnetic valve 19. The fixed element is formed in symmetry with respect to the axis.

The valve stem 16 made of a non-magnetic material is inserted into the bore of the cylindrical portion 24B of the second fixed iron core 24 in a non-contact state. The valve stem 16 has a reduced-diameter portion 33 at the distal end (upper end) thereof. A disk-shaped first movable iron core 34, permanent magnet 36 and second movable iron core 35 are stacked successively to form a movable element 42. The movable element 42 is fitted onto the reduced-diameter portion 33 of the valve stem 16 through the center hole thereof and thus secured to the reduced-diameter portion 33. In actuality, the distal end of the reduced-diameter portion 33 of the valve stem 16 projects from the movable element 42 and has an external thread formed thereon, and a nut is screwed onto the reduced-diameter portion 33, thereby securing the movable element 42. The movable element 42 is formed in symmetry with respect to the axis. An air gap is present between the outer peripheral edge of the movable element 42 on the one hand and, on the other, the inner peripheral edge of the annular intermediate plate 29, the inner peripheral edge of the first exciting coil 30 and the inner peripheral edge of the second exciting coil 31. The movable element 42 is supported axially movably by the valve stem 16 and the valve guide 17. A working air gap is present between the upper surface of the movable element 42 and the lower end surface of the first fixed iron core 23, and another working air gap is present between the lower surface of the movable element 42 and the upper end surface of the second fixed iron core 24.

The first exciting coil 30 and the second exciting coil 31 are axially symmetrical bilateral linear solenoids. The movable element 42 is magnetized so that the north and south poles are formed at two axial ends thereof. Thus, a linear solenoid valve is formed. A tapered slant surface (e.g. a slant surface with a frusto-conical shape having an inclination angle of 10 to 20 degrees) is formed on the outer side of the axially inner end portion of each of the cylindrical portions 23B and 24B of the first and second fixed iron cores 23 and 24 (i.e. each of the surfaces of the cylindrical portions 23B and 24B that face opposite to the movable element 42). Cylindrical projections 34A and 35A are formed on the respective axial end surfaces of the first and second movable iron cores 34 and 35 (i.e. the surfaces that face opposite to the first and second fixed iron cores 23 and 24, respectively). The cylindrical projections 34A and 35A each have an inversely-tapered slant surface (e.g. a slant surface with a frusto-conical shape having an inclination angle of 10 to 20 degrees) that is formed on the inner side of the distal end portion thereof.

As shown in FIG. 1, the first exciting coil 30 and the second exciting coil 31 are bifilar winding coils. That is, the first exciting coil 30 has a pair of coil elements 30A and 30B wound in opposite directions to each other. Similarly, the second exciting coil 31 has a pair of coil elements 31A and 31B wound in opposite directions to each other. The first exciting coil 30 and the second exciting coil 31 are excited by an exciting method (unipolar driving method) in which an electric current is passed through the pair of coil elements 30A and 30B (31A and 31B) in only one direction. In the first and second exciting coils 30 and 31, when one of the pair of coil elements 30A and 30B (31A and 31B) is energized, an attractive force is produced, whereas when the other coil element is energized, a repulsive force is produced (the one of the pair of coil elements will hereinafter be referred to as "the first coil element", and the other coil element as "the second coil element"). It should be noted that the arrangement may be such that the first and second exciting coils 30 and 31 are each formed by winding a single winding in the same direction and excited by an exciting method (bipolar driving method) in which an electric current is passed through the exciting coils bidirectionally, thereby causing the polarity to alternate.

Figure 2A:
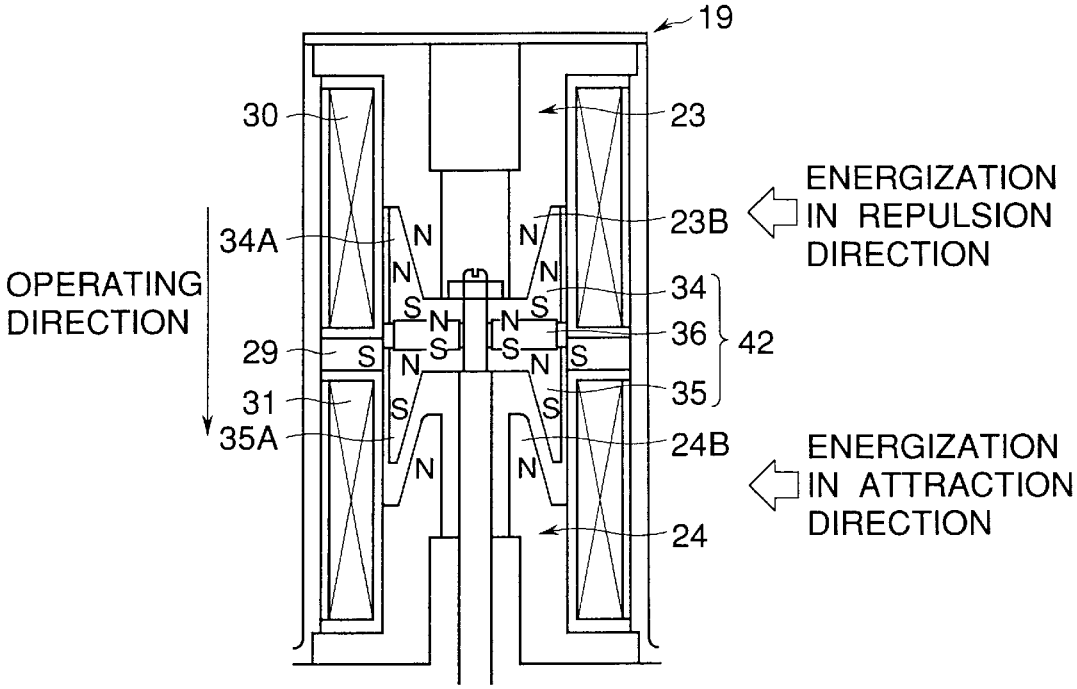

As shown in FIGS. 2A and 23, the permanent magnet 36 is magnetized so that the axially upper end thereof forms the north pole and the axially lower end thereof forms the south pole. In the first movable iron core 34, which is in contact with the upper side of the permanent magnet 36, the portion contacting the permanent magnet 36 forms the south pole, and the upper portion of the cylindrical projection 34A forms the north pole. Similarly, in the second movable iron core 35, which is in contact with the lower side of the permanent magnet 36, the portion contacting the permanent magnet 36 forms the north pole, and the lower portion of the cylindrical projection 35A forms the south pole. When an exciting current flows through each of the first exciting coil 30 and the second exciting coil 31 so as to form a magnetic circuit of the same direction as that of a magnetic circuit formed by the magnetic flux from the permanent magnet 36, the magnetic flux produced by the exciting current and the magnetic flux from the permanent magnet 36 are added together, causing a force to act on the movable element 7. The electromagnetic valve 19 operates with a smaller exciting current than in the case of the conventional electromagnetic valve shown in FIG. 6 and exhibits excellent response.

FIG. 2A shows the electromagnetic valve 19 in a state where the engine valve 11 is fully closed and the movable element 42 is at the upper stoke end. The tapered slant surface on the outer side of the distal end of the cylindrical portion 23B and the inversely-tapered slant surface on the inner side of the distal end of the cylindrical projection 34A are snugly fitted to each other. In this state, the second coil element of the first exciting coil 30 is energized in the direction for producing a repulsive force (this direction will hereinafter be referred to as "the repulsion direction"), while the first coil element of the second exciting coil 31 is energized in the direction for producing an attractive force (this direction will hereinafter be referred to as "the attraction direction"), as shown by the leftmost waveforms in part (d) of FIG. 3 and in part (d) of FIG. 4, thereby exciting the upper and lower magnetic circuits formed by the fixed element and the movable element 42. By the excitation, the distal end of the cylindrical portion 23B of the first fixed iron core 23 becomes the north pole, and the inner side of the annular intermediate plate 29 becomes the south pole. The distal end of the cylindrical portion 24B of the second fixed iron core 24 becomes the north pole. Consequently, a repulsive force acts between the north pole at the distal end of the cylindrical portion 23B of the first fixed iron core 23 and the north pole at the upper portion of the cylindrical projection 34A of the first movable iron core 34, and an attractive force acts between the south pole at the lower portion of the cylindrical projection 35A of the second movable iron core 35 and the north pole at the distal end of the cylindrical portion 24B of the second fixed iron core 24. The movable element 42, together with the engine valve 11, moves rapidly in the opening direction (downward) to reach the lower stroke end (where the engine valve 11 is open) and is held at this position by the excitation of the magnetic circuit formed by the magnetic flux from the permanent magnet 36.

Figure 2B:
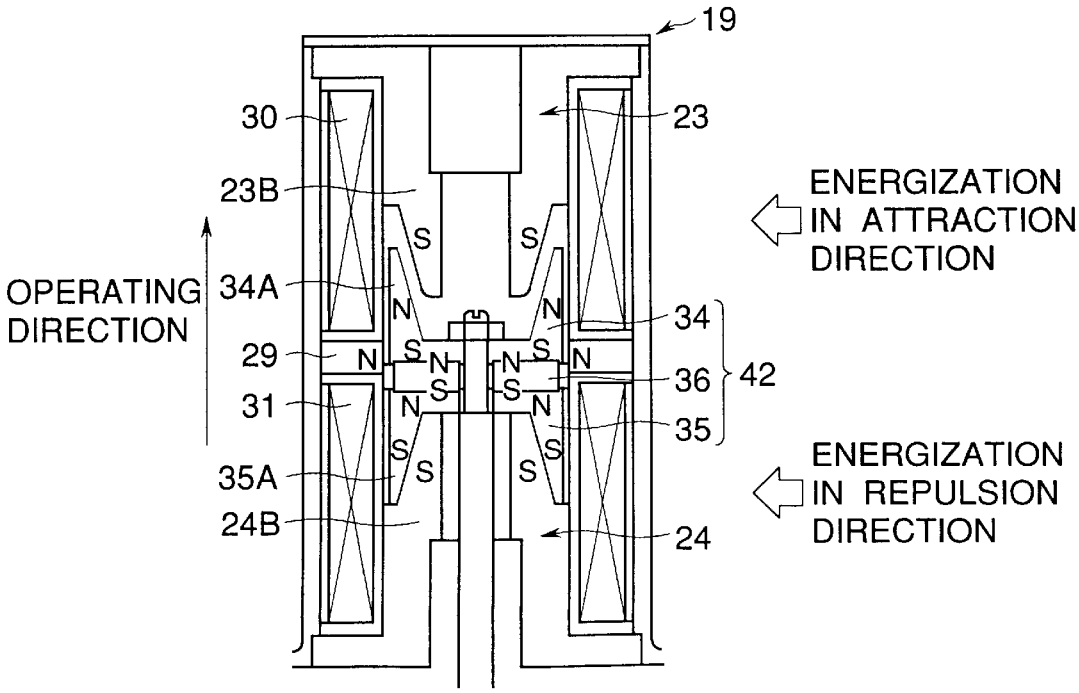

FIG. 2B shows the electromagnetic valve 19 in a state where the engine valve 11 is fully open and the movable element 42 is at the lower stroke end. The tapered slant surface on the outer surface of the distal end of the cylindrical portion 24B and the inversely-tapered slant surface on the inner side of the distal end of the cylindrical projection 35A are snugly fitted to each other. In this state, the first coil element of the first exciting coil 30 is energized in the attraction direction, while the second coil element of the second exciting coil 31 is energized in the repulsion direction, as shown by the second waveforms from the left in part (d) of FIG. 3 and in part (d) of FIG. 4, thereby exciting the upper and lower magnetic circuits formed by the fixed element and the movable element 42. By the excitation, the distal end of the cylindrical portion 23B of the first fixed iron core 23 becomes the south pole, and the inner side of the annular intermediate plate 29 becomes the north pole. The distal end of the cylindrical portion 24B of the second fixed iron core 24 becomes the south pole. Consequently, an attractive force acts between the south pole at the distal end of the cylindrical portion 23B of the first fixed iron core 23 and the north pole at the upper portion of the cylindrical projection 34A of the first movable iron core 34, and a repulsive force acts between the south pole at the lower portion of the cylindrical projection 35A of the second movable iron core 35 and the south pole at the distal end of the cylindrical portion 24B of the second fixed iron core 24. The movable element 42, together with the engine valve 11, moves rapidly in the closing direction (upward) to reach the upper stroke end (where the engine valve 11 is fully closed), and thus the valve head 14 rests on the seat ring 13. The movable element 42 and the engine valve 11 are held in this position.

Figure 3:
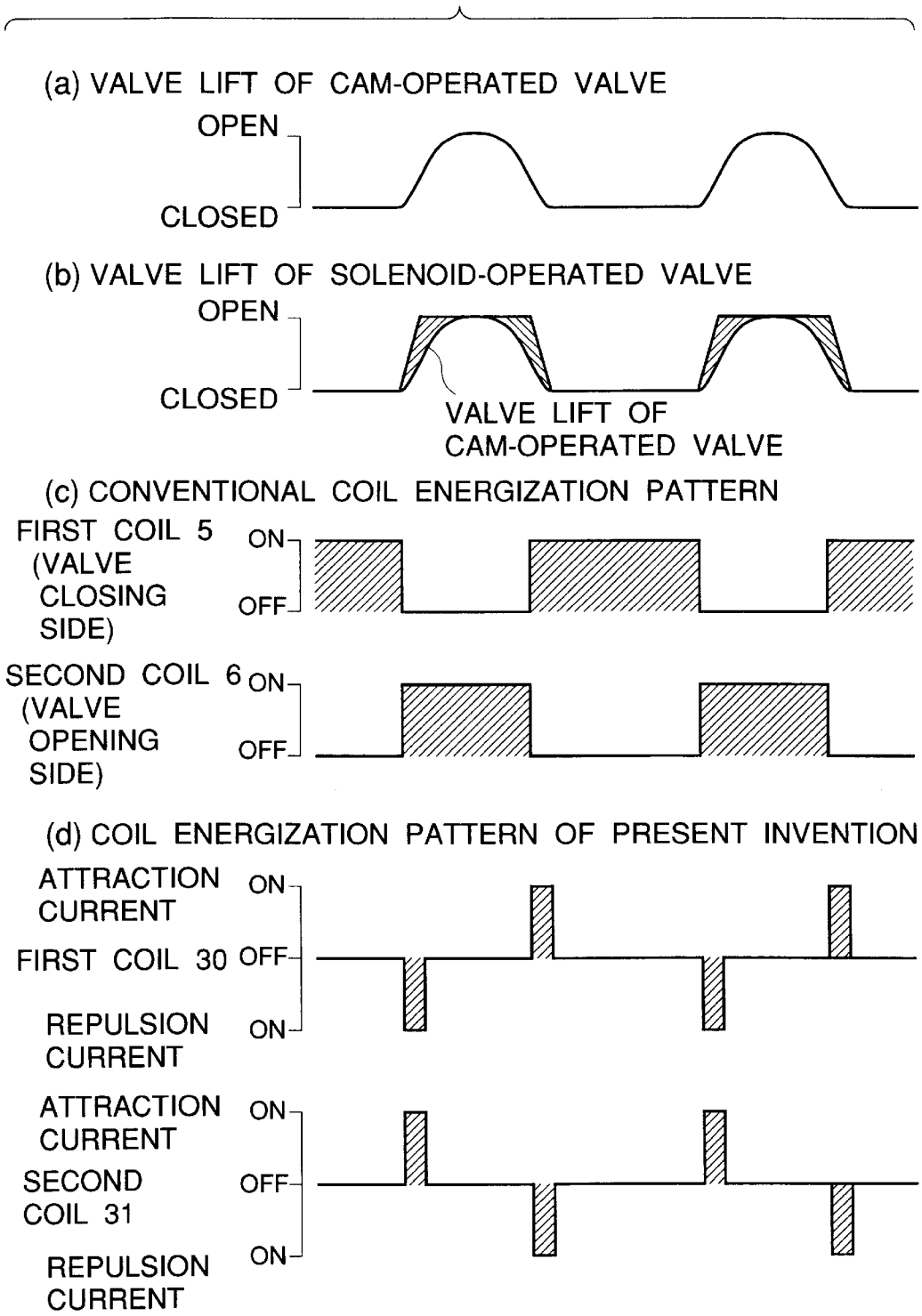
FIG. 3 is a diagram showing energization patterns in the high-engine speed region used in the embodiment of the present invention and the prior art.
Figure 4:
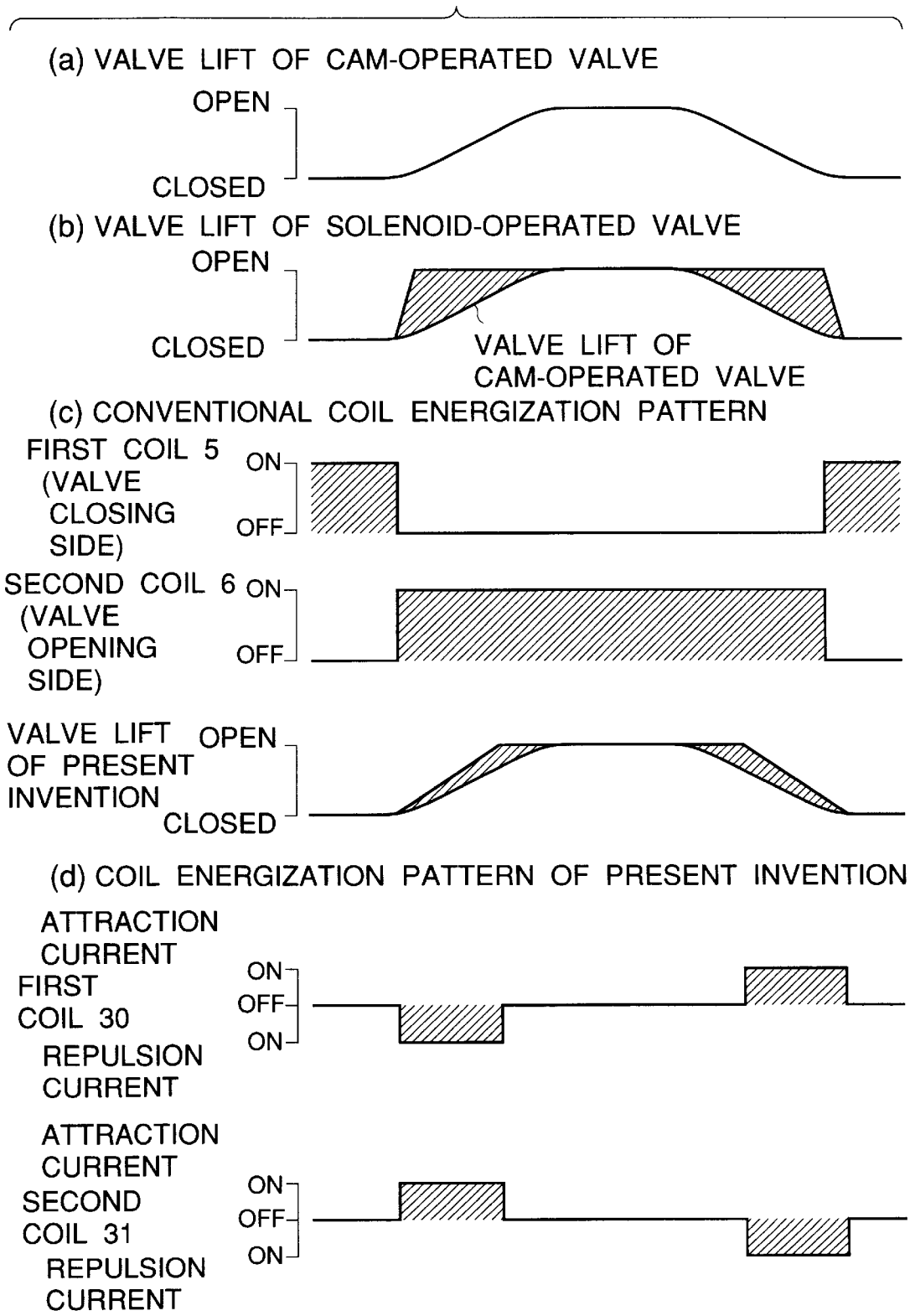
FIG. 4 is a diagram showing energization patterns in the low-engine speed region used in the embodiment of the present invention and the prior art.

FIG. 3 shows energization patterns in the high-engine speed region, and FIG. 4 shows energization patterns in the low-engine speed region. The valve lift of a solenoid-operated valve shown in part (b) of FIG. 3 and in part (b) of FIG. 4 corresponds to the valve lift of a cam-operated valve shown in part (a) of FIG. 3 and in part (a) of FIG. 4. In the prior art, energization is performed as shown in part (c) of FIG. 3 and in part (c) of FIG. 4. More specifically, when the engine valve 11 is closed, the first exciting coil 5 is energized continuously while the engine valve 11 is closed, and when the engine valve 11 is opened, the second exciting coil 6 is energized continuously while the engine valve 11 is open. In contrast, the coil energization pattern according to the present invention is as shown in part (d) of FIG. 3 and in part (d) of FIG. 4. That is, as stated above, to open the engine valve 11, the first exciting coil 30 is energized in the repulsion direction and the second exciting coil 31 is energized in the attraction direction for only a predetermined short period of time. To close the engine valve 11, the first exciting coil 30 is energized in the attraction direction and the second exciting coil 31 is energized in the repulsion direction for only a predetermined short period of time.

As shown in part (d) of FIG. 3 and in part (d) of FIG. 4, the repulsion and attraction electric currents are varied according to the engine speed. In the low-engine speed region, the current value is made smaller and the energization time is made longer than in the high-engine speed region. In the low-engine speed region, the time required for the crank angle of 720 degrees is long, and no problem will arise even if the response is slowed. Therefore, the current valve is reduced, the energization time is lengthened. The electric power consumption W is expressed by $$(\text{current } i)^2 \times (\text{resistance } R) \times (\text{energization time } t)$$

Therefore, the electric power consumption can be reduced by reducing the current value and lengthening the energization time.

Figure 5:
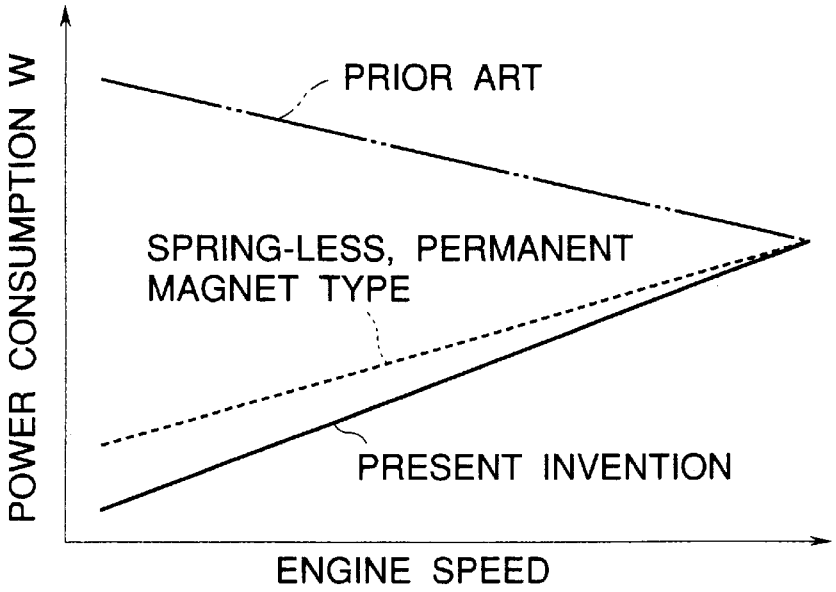
FIG. 5 is a diagram showing the relationship between the engine speed and the electric power consumption in various electromagnetic valves.

FIG. 5 shows the relationship between the engine speed and the electric power consumption. The chain double-dashed line shows the relationship between the engine speed and the electric power consumption in the prior art, and the dashed line shows the relationship in a permanent magnet type electromagnetic valve in which a permanent magnet is provided in the movable element and springs are omitted. As will be clear from the diagram, in the permanent magnet type electromagnetic valve, the electric power consumption is low in comparison to the prior art (because the permanent magnet type needs no electric power for holding the engine valve in the open and closed positions). The electric power consumption is further reduced in a case where the current value and the energization time are varied according to the engine speed as in the embodiment of the present invention.

It should be noted that the present invention is not necessarily limited to the foregoing embodiment but can be modified in a variety of ways without departing from the gist of the present invention.

What is claimed is:

1. In an engine valve-driving electromagnetic valve including:

a fixed element formed from a cylindrical casing of a ferromagnetic material, two fixed iron cores having cylindrical portions, respectively, two exciting coils, and an annular intermediate plate of a ferromagnetic material; and a movable element formed from a movable iron core, a permanent magnet, and another movable iron core, which are stacked successively, said movable element being secured to a distal end of a valve stem, and said movable element being supported axially movably between the cylindrical portions of said fixed iron cores;

said fixed element and said movable element being formed in symmetry with respect to an axis;

wherein an electric current is passed through said exciting coils to excite a magnetic circuit formed by said fixed element and said movable element, so that said movable element is driven in an axial direction by electromagnetic force, thereby driving an engine valve to open or close;

a method of driving said engine valve-driving electromagnetic valve, wherein said permanent magnet is magnetized in the axial direction, and when a repulsion electric current for producing a repulsive force is passed through one of said exciting coils, an attraction electric current for producing an attractive force is passed through the other of said exciting coils, thereby moving said engine valve to an open position where it is open, whereas when the attraction electric current is passed through the one of said exciting coils, the repulsion electric current is passed through the other of said exciting coils, thereby moving said engine valve to a closed position where it is closed, and wherein the repulsion electric current and the attraction electric current are varied according to an engine speed such that, in a low-engine speed region, an electric current value is smaller and an energization time is longer than in a high-engine speed region.

2. A method according to claim 1, wherein when said engine valve is in one of the closed position and the open position, a magnetic circuit is formed by a magnetic flux from said permanent magnet of said movable element, and by excitation of this magnetic circuit, said engine valve is held in the one of the closed position and the open position.

3. A method according to claim 1, wherein a cylindrical projection is formed on an end surface of each of the movable iron cores of said movable element, and wherein a tapered slant surface is formed on an outer side of a distal end of one of mutually opposing surfaces of each fixed iron core and the corresponding movable iron core of said movable element, and an inversely-tapered slant surface is formed on an inner side of a distal end. of the other of said mutually opposing surfaces, so that a magnetic flux passes through the two slant surfaces.

4. A method according to claim 2, wherein a cylindrical projection is formed on an end surface of each of the movable iron cores of said movable element, and wherein a tapered slant surface is formed on an outer side of a distal end of one of mutually opposing surfaces of each fixed iron core and the corresponding movable iron core of said movable element, and an inversely-tapered slant surface is formed on an inner side of a distal end of the other of said mutually opposing surfaces, so that a magnetic flux passes through the two slant surfaces.

* * * * *